US005172522A

United States Patent [19]

Jares

[11] Patent Number: 5,172,522

[45] Date of Patent: Dec. 22, 1992

[54] HANDLE USED ON A HAND HELD GRINDER OR BUFFER

[76] Inventor: Daniel J. Jares, 17403 Guinn, Houston, Tex. 77044

[21] Appl. No.: 802,888

[22] Filed: Dec. 6, 1991

[51] Int. Cl.[5] ..... B24B 23/00

[52] U.S. Cl. ..... 51/170 R; 16/114 R; 30/514

[58] Field of Search ..... 51/170 R, 170 PT, 170 T; 16/110 R, 113, 114 R, 125, 116 R, 126; 30/514, 517, 522, 523

[56] References Cited

U.S. PATENT DOCUMENTS

| | | | |
|---|---|---|---|
| D. 215,276 | 9/1969 | Spargo . | |
| D. 284,831 | 7/1986 | Warwicker . | |
| 1,693,163 | 11/1928 | Schacht . | |
| 1,803,337 | 5/1931 | Lundquist . | |
| 1,837,808 | 12/1931 | Cobb . | |
| 2,417,620 | 3/1947 | Soderberg . | |
| 2,590,820 | 3/1952 | Jedlicka . | |
| 2,595,695 | 5/1952 | Packer et al. . | |
| 2,800,372 | 7/1957 | Seyfried . | |
| 2,891,360 | 6/1959 | Duffie . | |
| 3,914,905 | 10/1975 | Waters | 51/170 PT |
| 3,928,947 | 12/1975 | Millett . | |
| 4,188,934 | 2/1980 | Reinhardt et al. | 51/170 PT |
| 4,193,228 | 3/1980 | Bowler . | |
| 4,462,381 | 7/1984 | Fushiya et al. . | |
| 4,962,617 | 10/1990 | Tilders et al. . | |

FOREIGN PATENT DOCUMENTS

| | | | |
|---|---|---|---|
| 3634424 | 4/1988 | Fed. Rep. of Germany | 51/170 R |
| 0456956 | 4/1950 | Italy | 51/170 R |

OTHER PUBLICATIONS

Photograph of the Black & Decker No. 4049 7 in./9 in. Sander.

*Primary Examiner*—Roscoe V. Parker
*Attorney, Agent, or Firm*—Kenneth A. Roddy

[57] ABSTRACT

A U-shaped handle is disclosed that replaces the protruding pole handle curently supplied with commercial grinders or buffers. The U-shaped handle is wide enough at a first end to allow the gloved fingers of a large hand to fit inside and narrow enough at a second end to fit closely to the sides of the grinder when attached to the grinder housing. Two bolts feed through holes in each side of the U-shaped handle and are screwed into the housing of the grinder where the protruding pole type handle normally was screwed in. The bolts have unthreaded portions enabling the handle to pivot. Finger notches cut into the first end of the handle reduce lateral movement of the handle in the user's hand during grinding. The handle may be manufactured from plastic or other insulated material to provide insulation from electrical shock.

6 Claims, 1 Drawing Sheet

HANDLE USED ON A HAND HELD GRINDER OR BUFFER

BACKGROUND OF THE INVENTION

1. Field of the Invention

The present invention relates to a handle used on a hand held power tool that rotates a grinding wheel, buffing wheel, or sanding wheel. The invention relates particularly to a handle of an industrial grinder.

2. Description of Related Art

FIG. 1 shows a prior art power tool 1. In general, such a tool has a body that houses an electric motor and a drive train which terminates in a rotatable drive shaft. The rotatable drive shaft extends from the body and is usually adapted to engage attachments such as wheel 9. Typical attachments for power tool 1 include a grinding wheel, a saw blade, a buffing wheel, or a sanding wheel. The attachments are commonly interchangeable.

Power tool 1 or grinder 1, is sold commercially with a detachable protruding pole handle 3. Pole handle 3 has a bicycle-type grip. Pole handle 3 can be screwed into one of threaded holes 5 or 7 depending on the location in which grinder 1 is being used.

Commercially available grinders similar to grinder 1 with pole handle 3 are listed below:

| Manufacturer | Description | Model No. |
|---|---|---|
| Black & Decker | 7 in. Sander Polisher | No. 9531 |
| Black & Decker | 4½ in. Angle Grinder | No. 2750 |
| Black & Decker | 7 in. Sander | No. 4076 |
| Black & Decker | 7 in./9 in. Sander | No. 4049 |
| RYOBI | 4 in. Grinder | No. SG 1000 |
| Milwaukee | 4½ in. Sander-Grinder | No. 6145 |

Other companies such as Mikita and Sears also offer grinders with pole handles similar to pole handle 3.

Unfortunately, pole handle 3 does not always provide complete safety and flexibility for the user. Pole handle 3 tends to slip out of the user's hand when the grinding wheel or other type rotating tool suddenly stops. This can happen when wheel 9 is pinched during cutting, grinding, or buffing to clean the end of a pipe. Operators in chemical plant construction typically remove handle 3 when working in close quarters which further decreases safety. Pole handles are also typically removed from grinders used on oil or gas pipelines because changing pole handle 3 between threaded holes 5 and 7 is required to grind around the circumference of a pipe, a time consuming task. Absence of a handle makes the grinder more difficult to control and much more likely to slip out of the operator's hand and cause injuries.

FIG. 2 shows a situation where no handle on grinder 1 is used because the handle would have to be constantly swapped from side to side when extending a cut, grind, or buff 13 around the circumference of a typical 36 in. diameter gas pipeline 15. Pole handle 3 may also be constantly removed and replaced because ground 17 is too close to the pipeline to grind beneath with the pole handle attached. As mentioned previously, when grinders are used without a handle as shown in FIG. 2, the grinder is more likely to slip out of the operator's hands and cause severe injuries.

SUMMARY OF THE INVENTION

The present invention is a U-shaped handle that replaces the conventional protruding pole handle currently supplied with commercial grinders or buffers. Preferably, the U-shaped handle is wide enough at a first end to allow the gloved fingers of a large hand to fit inside and narrow enough at a second end to fit closely to the sides of the grinder when attached to the grinder housing.

Two bolts feed through holes drilled in each side of the U-shaped handle. The bolts are screwed into the housing of the grinder where the prior art pole handle normally was screwed in. The bolts have unthreaded portions that act as journals enabling the U-shaped handle to pivot.

Finger notches, cut into the first end of the U-shaped handle, reduce lateral movement of the handle in the user's hand during grinding. Preferably, the U-shaped handle is manufactured from plastic to provide insulation from electrical shock. Electrical shock typically occurs on wet humid days, when working near high voltage powerlines, when working near welding cables, or when the grinder shorts out.

The present invention addresses the problems described above. The present invention provides added safety because the U-shaped handle is less likely to slip out of the user's hand when the grinding wheel is pinched or strikes a burr. The present invention also does not protrude out as far from the side of the grinder as the prior art so the user does not have to remove the U-shaped handle when operating in close quarters.

It is another feature of the invention that presently configured grinders may readily accommodate the present invention.

BRIEF DESCRIPTION OF THE DRAWINGS

Further details of the present invention are explained with the help of the attached drawings in which.

DESCRIPTION OF THE PREFERRED EMBODIMENTS

Figure 3:
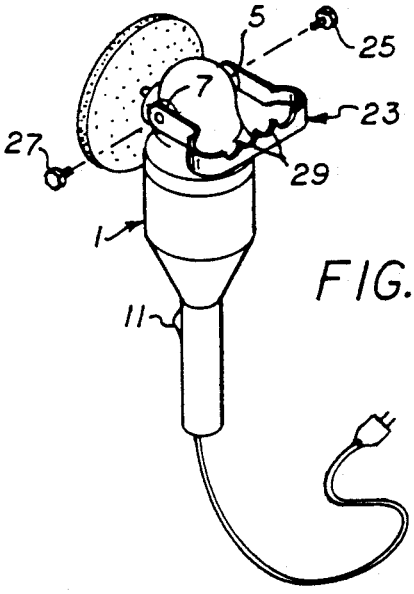
FIG. 3 shows a grinder with a U-shaped handle of the present invention.

FIG. 3 shows a grinder with the U-shaped handle 23 of the present invention. The U-shaped handle 23 enables the grinder to be operated more safely because handle 23 will catch the user's fingers when the grinding wheel is suddenly pinched or strikes a burr rather than slipping away like prior art pole handle 3 of FIG. 1.

To further control movement of an operator's fingers, finger notches 29 are cut or molded into handle 23. Finger notches 29 reduce lateral movement of handle 23 in the user's hand during grinding. Finger notches 29 also reduce movement of the user's fingers in and out of handle 23 because the finger notches contact more of the user's hand. The notches accommodate a person with a small or large hand wearing gloves, whether the person is right or left handed.

Figure 1:
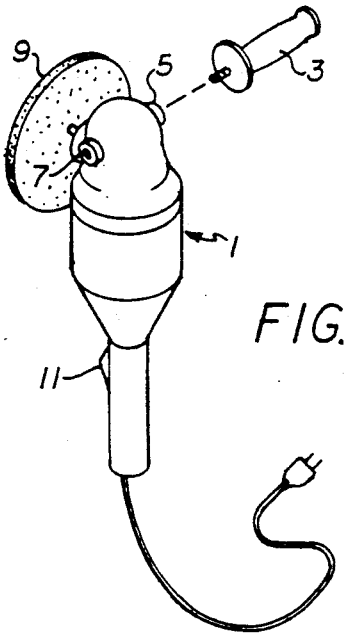
FIG. 1 shows a prior art grinder that comes with a detachable protruding pole handle with a bicycle type grip.

U-shaped handle 23 is attachable by bolts 25 and 27 which screw into threaded holes 5 and 7. A portion of each bolt is unthreaded enabling the handle 23 to pivot. As can be seen in FIGS. 1 and 3, handle 23 has an advantage over pole handle 3 in that it does not protrude out to the side of the grinder and can be used in much closer quarters. With the pivoting feature, handle 23 can be used in even closer confines because handle 23 can be pivoted backward or forward to provide more clearance. The pivoting feature of handle 23 also enables it to be more effectively used as a carrying handle.

As a further safety feature, handle 23 can be molded from plastic or machined from other electrically insulating materials to provide insulation from electric shock.

Figure 4A:
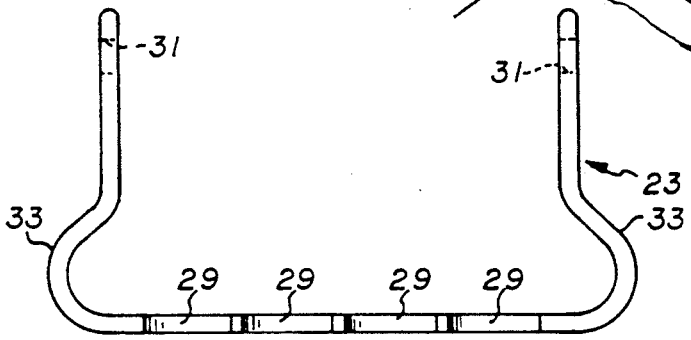
FIG. 4A shows a top view of the handle of FIG. 3.
Figure 4B:
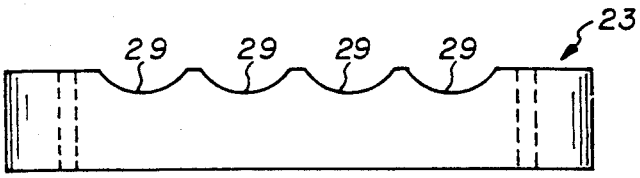
FIG. 4B shows a front view of the handle of FIG. 3.
Figure 4C:
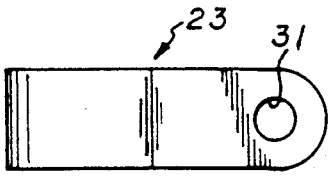
FIG. 4C shows a side view of the handle of FIG. 3.

FIGS. 4A–4C show more detailed views of the handle 23. FIG. 4A shows a top view of the handle 23. In FIG. 4A, dashed lines show where bolt holes 31 are drilled into handle 23, and finger notches 29 can also be seen.

In FIG. 4A, the detail of the shape of handle 23 may also be seen. Handle 23 has curves 33 enabling it to be large enough for a person wearing gloves which have become hard and stiff from weeks of use to insert gloved fingers into the first end and small enough at a second end to be attached closely to the grinder. Curves 33 in handle 23 are placed close to the grinder so that the user's fingers may be wrapped around the handle or placed under the handle with the handle then acting as a means of strapping the user's hand onto the grinder. The handle 23 of the present invention can be made to fit most grinders, and other unusually shaped grinders can be fitted with only slight changes in dimensions.

FIG. 4B shows a front view of the handle 23 and clearly displays the finger notches 29.

FIG. 4C shows a side view of the handle 23 and clearly displays bolt holes 31.

Figure 2:
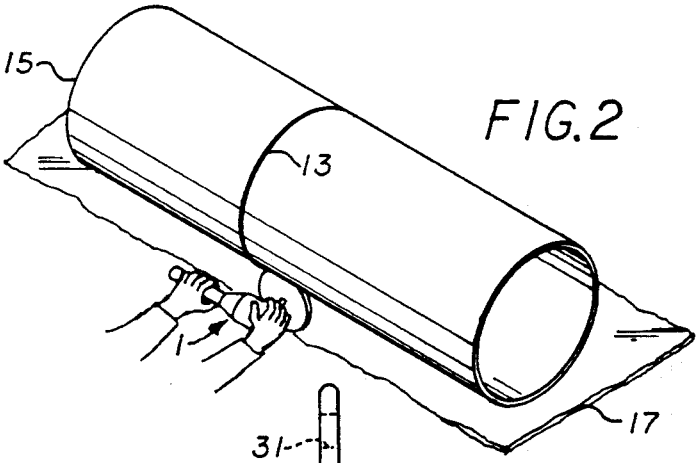
FIG. 2 shows a situation where no handle is used when cutting, grinding, or buffing around the circumference of a gas pipeline.

Referring back to FIG. 2, one can see that with handle 23 of the present invention attached, the grinder can still be used to cut, grind, or buff around the circumference of the gas pipeline 15 without being removed. With the operator's fingers inserted through the U-shaped handle, if the grinder wheel is pinched or strikes a burr as it passes underneath the gas pipeline, the operator's hand is more likely to be held by the handle to prevent the grinder from jumping back and striking the operator.

The present invention has been primarily described for use on industrial grinders used to cut, grind, or buff welds on oil, gas, and chemical pipelines, but the present invention can also be used on nonindustrial grinders or buffers. Nonindustrial grinders or buffers are currently available to general consumers for buffing, sanding, or doing minor body work on automobiles. The present invention offers the same increased safety and more accurate and easier handling for these nonindustrial grinders or buffers as it does industrial grinders.

Although the present invention has been described for use with grinders or buffers, the handle can be used on similar devices such as a drill which typically operates at lower revolutions per minute than a grinder.

The invention has been described above with particularity, to teach one of ordinary skill in the art how to make and use the invention. Many modifications will fall within the scope of the invention, as that scope is defined by the following claims.

What is claimed is:

1. A replacement safety handle for replacing the existing pole handle of a power tool of the type having an elongate cylindrical housing and a rotating buffing or grinding attachment at a first end, a removable pole handle selectively threadedly engaged in threaded holes on either side of the first end and the cylindrical housing having a second end gripped by a user's hand, the replacement handle comprising:

a generally U-shaped handle member having a central hand grip portion with a series of longitudinally spaced finger notches, opposed outwardly curved leg portions at each end of said hand grip portion and laterally opposed parallel straight portions extending from said outwardly curved portions, said handle member hand grip portion and the distance between the opposed outwardly curved portions of said leg portions being of sufficient width to receive a gloved hand of a user, a hole through the laterally opposed parallel straight portions near the terminal ends of each in axial alignment with one another to receive the shaft of a bolt member, said laterally opposed parallel straight portions being received closely adjacent each of the threaded holes on either side of said generally cylindrical housing, and a pair of bolt members for pivotally connecting said U-shaped handle member to the threaded holes on either side of the first end of said power tool cylindrical housing when the existing pole handle is removed therefrom, said U-shaped handle member being pivotally movable between a forward and backward position relative to said housing first end.

2. The handle as claimed in claim 1 wherein the shank of said bolts have a threaded portion threadedly received in said housing threaded holes and an unthreaded portion received in said handle leg portion holes to allow free movement between the forward and backward positions.

3. The handle as claimed in claim 1 in which said U-shaped handle member is formed of flat rectangular material.

4. The handle as claimed in claim 1 in which said U-shaped handle member is made from an electrically insulating material.

5. A hand held power tool comprising:

an elongate generally cylindrical housing having a first end and a second end, the second end which can be gripped by a user's hand;

a rotatable drive shaft protruding from the first end of said housing;

a pair of shafts protruding radially outward from each side of the first end of said housing; and a generally U-shaped handle pivotally attached to said pair of shafts said handle member having a central hard grip portion with a series of longitudinally spaced finger notches, opposed outwardly curved leg portions at each end of said hand grip portion and laterally opposed parallel straight portions extending from said outwardly curved portions, said handle member hand grip portion and the distance between the opposed outwardly curved portions of said leg portions being of sufficient width to receive a gloved hand of a user, a hole through the laterally opposed parallel straight portions near the terminal ends of each in axial alignment with one another to be received on said pair of shafts, said U-shaped handle member being pivotally movable between a forward and backward position relative to said housing first end.

6. A hand held power tool comprising:

an elongate generally cylindrical housing having a first end and a second end, the second end which can be gripped by a user's hand;

an electrical motor contained within said housing;

an on/off switch in the second end of said housing operatively connected to said electrical motor to control the operation thereof;

a drive shaft connected to said electrical motor and rotated thereby, the drive shaft protruding from the first end of said housing;

a threaded hole at each side of the first end of said housing in axial alignment;

a first handle member and a second handle member selectively interchangeable with one another and adapted to be removably connected to said threaded holes;

said first handle member comprising an elongate tubular member having threads at one end to be removably connected in either said threaded hole to extend rigidly outward from one side of the first end of said housing; and said second handle member comprising a generally U-shaped member having a central hand grip portion with a series of longitudinally spaced finger notches, opposed outwardly curved leg portions at each end of said hand grip portion and laterally opposed parallel straight portions extending from said outwardly curved portions, and the straight portions adapted to be pivotally connected to said threaded holes;

said handle member hand grip portion and the distance between the opposed outwardly curved portions of said leg portions being of sufficient width to receive a gloved hand of a user and being pivotally movable between a forward and backward position relative to said housing first end.

* * * * *